US007245083B2

(12) United States Patent
Rodriguez

(10) Patent No.: US 7,245,083 B2
(45) Date of Patent: Jul. 17, 2007

(54) INCANDESCENT LAMP WITH INTEGRAL CONTROLLING MEANS

(75) Inventor: Edward T. Rodriguez, Winchester, MA (US)

(73) Assignee: LongLite, LLC, New York, NY (US)

( * ) Notice: Subject to any disclaimer, the term of this patent is extended or adjusted under 35 U.S.C. 154(b) by 0 days.

(21) Appl. No.: 11/313,423

(22) Filed: Dec. 20, 2005

(65) Prior Publication Data

US 2006/0152161 A1 Jul. 13, 2006

Related U.S. Application Data

(60) Provisional application No. 60/643,083, filed on Jan. 11, 2005.

(51) Int. Cl.
*H01J 7/44* (2006.01)

(52) U.S. Cl. ..... 315/58; 315/73; 361/718; 361/719; 445/23; 445/69; 362/364; 362/448

(58) Field of Classification Search ..... 315/51, 315/56–58, 61–64, 73; 362/362–365, 437, 362/441, 443, 444, 448, 548, 549; 445/23, 445/66, 69; 361/702, 709, 712, 714, 718–723; 313/315–317, 318.01; 439/620.01, 620.06, 439/699.2

See application file for complete search history.

(56) References Cited

U.S. PATENT DOCUMENTS 3,215,891 A 11/1965 Fritz et al.
3,762,654 A * 10/1973 Haslett et al. ..... 362/268
3,818,263 A 6/1974 Belko
3,823,339 A 7/1974 Borneman et al.
3,859,554 A * 1/1975 Preziosi et al. ..... 313/315
4,480,212 A 10/1984 Monahan et al.
4,980,607 A 12/1990 Albert et al.
5,585,697 A * 12/1996 Cote et al. ..... 315/157
6,075,318 A * 6/2000 Noll et al. ..... 313/573
6,515,858 B2 2/2003 Rodriguez et al.
6,731,071 B2 * 5/2004 Baarman ..... 315/51

OTHER PUBLICATIONS

Rodriguez, Edward T., "Cooling a High Density DC-DC Converter Impacts Performance and Reliability," PCIM Magazine, Nov. 1999, pp. 60-66.

* cited by examiner

*Primary Examiner*—Haissa Philogene
(74) *Attorney, Agent, or Firm*—Edwin H. Paul, Esq.; Cesari and McKenna, LLP

(57) ABSTRACT

An incandescent lamp has incorporated a circuit board within a recess in the bulb, wherein the circuit board contains connections and circuitry to control power to the lamp filament while maintaining the attachment of the bulb to the metal base, wherein the completed lamp assembly including the circuit board and the metal base maintains the external physical dimensions to fit into standard incandescent light fixtures. The circuitry on the circuit board contains performance-modifying or performance-monitoring electronic circuitry configured to reflect the restrictive size and thermal considerations while employing designs and manufacturing processes most typically found in such products.

8 Claims, 4 Drawing Sheets

INCANDESCENT LAMP WITH INTEGRAL CONTROLLING MEANS

CROSS REFERENCE TO RELATED APPLICATIONS

The present application claims the benefit of U.S. Provisional Patent Application Ser. No. 60/643,083, which was filed on Jan. 11, 2005 of common inventorship and title and which provisional application is hereby incorporated herein by reference.

BACKGROUND OF THE INVENTION

1. Field of the Invention

The present invention relates to incandescent lights, and, more particularly, to adapters designed to improve their performance.

2. Background Information

Over the past 40 years, particularly since semiconductor devices have become readily available, there has been substantial activity (including patenting such devices) relating to adapters which can enhance or modify the performance of incandescent lights, which henceforth will be referred to collectively as lamps. Most of the prior art has related to adaptive devices which can be affixed to the external screw base of the lamps in either a removable or non removable way. U.S. Pat. Nos. 3,818,263 and 4,989,607 illustrate removable adapters, and U.S. Pat. No. 3,823,339 shows a permanent adapter. Some configurations have involved adaptations within the glass envelope itself prior to the screw base being attached, for example U.S. Pat. No. 4,480,212 describes such an assembly. Each of the foregoing U.S. Patents are hereby incorporated herein by reference.

Present in virtually all of the adaptive approaches is concern about filament-generated heat. Such heat can degrade performance of the semiconductors or other electronic components involved. Silicon semiconductor devices typically do not have ratings much over 150 degrees C. The presence of self-generated heat, along with a very high filament cause ambient temperature can be a destructive combination. U.S. Pat. No. 4,480,212 notes such heat considerations. This Patent is hereby incorporated herein by reference.

An earlier patent, U.S. Pat. No. 3,215,891, notes that silicon rectifiers have a relatively high temperature capability, typically to 150 degrees C. (Celsius), and, having a relatively simple device structure, do not exhibit the thermal runaway characteristics of semiconductors which either have multiple junctions or have properties which are very sensitive to thermal effects. This patent is hereby incorporated herein by reference. Consequently, it is feasible to place such device within the glass envelope of the lamp and still have them survive the high ambient temperature.

However, as adaptive techniques have evolved which employ multi-junction semiconductors, there tends to be more vulnerability to performance degradation at high temperatures. An article by the present inventor, E. Rodriguez, entitled, "Cooling a High Density DC-DC Converter Impacts Performance and Reliability" PCIM Magazine, November 1999 pp 60–66 describes in detail the principles of heat removal from a semiconductor chip and the subtleties of optimizing such heat removal paths. U.S. Pat. No. 6,515,858 further describes such heat removal principles and how the functional stability or failure susceptibility of any given semiconductor is a function of its closeness to its maximum operating temperature. This patent is hereby incorporated herein by reference.

It has been noted that it is the combination of ambient temperature with self-generated heat which is the destructive combination. In other words, a device might very well survive the high temperature within a lamp glass envelope but the self generated heat, if not removed, raises the junction temperature far above acceptable levels. Consequently, in prior art, it has generally not been possible to place within the glass envelope of a lamp any silicon semiconductors of a dissipative nature other than simple rectifier diodes. Non silicon, multi-junction semiconductors, employing materials such as gallium arsenide can withstand much higher temperatures, but the costs and performance limitations of such devices has precluded them from commercial lighting applications.

In a typical Edison base incandescent lamp, it is customary to have the filament enclosed with a sealed glass envelope, essentially evacuated of air and then filled with certain inert gases within that envelope to promote longer filament life. The design of the filament and the types of gases employed within the envelope are not particularly relevant to the proposed embodiment and will therefore be omitted from further description. Suffice it to say a wire is connected, within the sealed glass bulb envelope, to each end of the filament. In one small area of the glass envelope, through which the air is evacuated, the glass is essentially pinched and sealed by heating the glass in that area to the melting point in the manner noted in the bottom of a typical glass thermometer.

The two wires from the filament pass through that pinched and sealed glass area. This forms what is called a glass-to-metal seal in that no air or other gas can escape or pass through the same tiny hole through the wire passes. The two wires, now being outside of the sealed glass envelope, are directed to, and soldered or welded within, two holes in the screw base, one hole being in the center and one being on the periphery. The center connection will subsequently make contact with the center contact of a socket while the outer contact will make contact to the outer screw shell of a socket.

In a final configuration, having the screw base attached to the glass envelope, there is very little air space within the screw base in which to place any electronic device or circuit board.

Furthermore, because of the special shapes involved for the pinched and sealed glass area, as well as glass insulation cones within the screw base, there is a less than ideal environment in which to install an electronic circuit, aside from the need to address thermal considerations. It is therefore a principal objective of the proposed embodiment to make best use of the minimal space in a way which exhibits thermal advantages.

To those skilled in the art relative to power semiconductors and associated heat sinking or cooling considerations, it is known that cooling is very dependent on the metallic surface area to which a semiconductor chip is attached. Reference 1 describes in detail the concept of thermal resistance and the physics of such a concept need not be further described. Generally, it is known that the junction of a semiconductor will elevate in temperature in accordance with what is called its thermal resistance, specified in degrees C. per watt to the ambient air. That means, for example that the semiconductor will increase in temperature a predictable amount for every watt of power. The temperature rise will typically be cut in half for every quadrupling of the surface area to which the semiconductor chip is affixed in a thermal conductive manner.

When the semiconductor is in chip form (i.e. unpackaged) or is in a small surface mount package, It has very little surface area and its thermal resistance for example can be as high or higher than 200 degrees C. per watt. Therefore, it is imperative for a device handling any amount of power that the surface area, to be significantly more than the chip itself. Otherwise, the chip can handle almost no power—not because it can intrinsically carry little current but because it simply overheats.

For example, microprocessor chip in a computer by itself might handle only a small fraction of a watt, and therefore be rendered useless, but mounted properly onto a metallic thermally conductive surface of area much greater than the chip itself, can handle tens of watts. In the proposed embodiment therefore, it is the intent to define a configuration in which the mounting surface is substantially greater than the component itself. It is not the three dimensional shape of the mounting surface which is most important but rather the total surface area.

SUMMARY OF THE INVENTION

The limitations of the prior art are overcome and other advantages are provided by the present invention. Accordingly, within the tiny confined area within an Edison lamp, such as a typical 60 or 100 watt lamp, it can be observed that, for purposes of the proposed embodiment, that there is room for a cylindrical metal surface having a diameter of approximately 300 mils (a mil being one/thousandths of an inch) and a length of approximately 750 mils. The available space is in a recess resulting from the way the overall glass envelope is shaped and sealed. This thermally conductive metal cylinder, spread out as a flat surface, would have a surface area of approximately 135,000 square mils.

When a chip, 60 by 60 mils, having an area of only 3600 mils, is attached to the metal surface, it can be noted that the thermally useful surface area is increased more close to 36 times. The power capability increases approximately as a function of the square root of the surface area so it can be determined that with the cylinder, the chip can handle about six times more power. A surface area of about 135,000 square mils provides a thermal resistance of about 30–35 degrees C. per watt in non-moving air.

To illustrate the implications of such an arrangement, it is useful to use such a device as the Sidac chip employed in U.S. Pat. No. 4,980,607. This patent is incorporated herein by reference. The Sidac is a multi junction, bi-directional device, which can operate effectively up to a junction temperature of 150 degrees although lower operating temperature is preferred. Within the lower enclosed portion of a typical 100-watt Edison base lamp operating in a base-down position, in a 25 degrees C. outer room temperature environment, the temperature can typically be in the 85–95 degrees C. range.

If such a Sidac chip were to be by itself, it would have a forward voltage drop of approximately 1.2 volts at the approximate 0.75 amps (somewhat less than with a bulb having no Sidac circuit) associated with a 100 watt lamp at a nominal 115 VAC. These figures would translate into chip dissipation of about 0.9 watts.

With a bare chip having a thermal resistance of about 180 degrees C. per watt, the chip would rise to nearly 240 degrees C. and be damaged. Attached to the cylinder with its 30 degrees C. per watt characteristic, it would only increase to about 110–120 degrees. In a base up configuration, rising heat from the filament can make the inner ambient temperature 30–40 degrees hotter, making operation acceptable but not recommended at 100 watts but quite satisfactory with a 60 or 75 watt lamp since the self heating is less and the final Sidac temperature is less. It can be seen from these considerations that the surface area is extremely important. A reduction in cylinder surface area of 40–50% could render the Sidac inoperable inside a 60 or 100-watt lamp due to excessive Sidac junction temperature.

In practice, the thermally conductive metal cylinder can be the copper foil layer which is part of a conventional printed circuit board (PCB). With this approach a Sidac chip and any other appropriate chips can be surface mounted onto the circuit board and interconnected by the etched traces on the PCB. The copper thickness of such a PCB can be up to about 6 mils thick and still be within the range of commercially available cost effective materials. The non-copper base material for the PCB, such as G-10 epoxy glass laminate, is available in thickness of only a few mils. Using such a thin laminate of G-10 or of a high-temperature polyimide used in what are called "flex circuits" allows the PCB to be easily formed into a cylinder.

Prior to such cylindrical forming, many small device-containing PCB's can be fabricated as what is known as a pallet and then separated into individual PCB's. Those skilled in the art of circuit board manufacturing are familiar with such multiple PCB, palletized manufacturing techniques. Once the cylindrical PCB has been formed with the appropriate components already attached, it can be inserted into the intended space with one of the wires from the lamp filament, which would have normally gone to the center hole of the screw base, instead go to a hole in the PCB.

Another wire then goes from a second hole in the PCB to the screw base center hole. In other words, the PCB and its circuitry are interjected into one of the AC lines intended for the lamp filament. With this embodiment, the performance of the lamp can be appropriately enhanced while retaining, for the end user, the appearance and installation simplicity of a standard bulb.

The interjected, now integral with the bulb, circuitry may serve to extend lamp life, react to external signals or perform any other such desired function requiring temperature-sensitive multi-junction semiconductor devices for meeting those performance objectives. Furthermore, the approach allows fabrication of an enhanced end product without the need to alter in any way the basic manufacturing process of the lamp itself. In other words, the fundamental technology of lamp manufacturing is in the filament and placement within the sealed glass envelope.

The addition of the screw base, while an important aspect, is considered a secondary, less critical operation and simply a means to connect to the filament. In other words, the proposed embodiment can be added to a lamp without meaningfully altering the economies of scale of the most important lamp production processes. U.S. Pat. No. 4,480,212 shows elements placed within the glass envelope of a lamp for conceptual purposes but in terms of the overwhelming majority of Edison base lamps produced for consumer use, it is not practical to incorporate electronic devices within the evacuated portion of the glass envelope without creating an extremely specialized manufacturing process unique to the assembly. This patent is incorporated herein by reference.

It will be appreciated by those skilled in the art that although the following Detailed Description will proceed with reference being made to illustrative embodiments, the drawings, and methods of use, the present invention is not intended to be limited to these embodiments and methods of use. Rather, the present invention is of broad scope and is intended to be defined as only set forth in the accompanying claims.

DETAILED DESCRIPTION OF PREFERRED EMBODIMENTS

Figure 1:
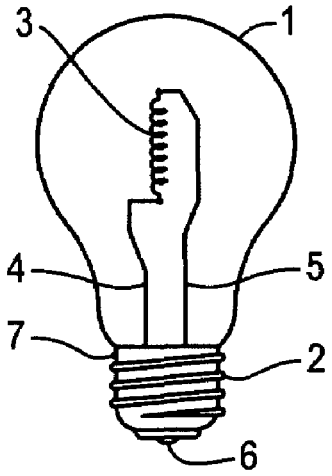
FIG. 1 PRIOR ART
FIG. 1 shows a typical Edison-base incandescent lamp

FIG. 1 shows a standard Edison base incandescent lamp having a glass outer envelope 1 an internal filament 3 an electrically conductive, a standard screw-in metallic base 2 with appropriate formed threads to facilitate insertion into a standard lamp socket of fixture. In such a complete lamp configuration there will be evident a small soldered connection at the lower tip of the screw base 6 and a second small soldered or welded connection on the upper portion of the outer screw shell 7. These two points are the terminations for two wires 4 and 5 coming from the internal filament.

Figure 2:
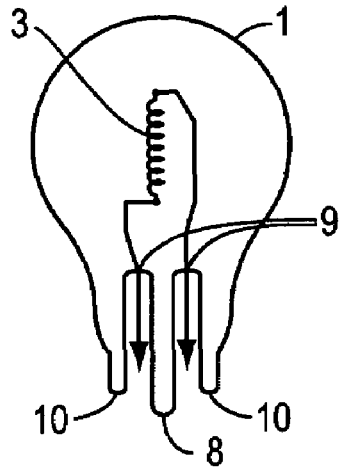
FIG. 2 PRIOR ART
FIG. 2 shows the sealed glass bulb envelope

FIG. 2 shows the lamp prior to final assembly. The lower portion of the glass bulb is formed in such a way that a center section protrudes downward and the lower end of the protruding section 8, after being used to both evacuate air from the glass bulb and insert any appropriate performance-enhancing gases, is heated to its melting point so as to form a hermetic seal.

Similarly, wires from the filament are passed though holes 9 in the glass in a manner which maintains the hermetic seal. It can be noted that the outer surface of the glass bulb comes down from the spherical portion to a lower portion, with a flat lower surface 10, before reversing direction, traveling upward toward the filament and then reversing again to drop down toward the sealed portion. That lower surface 10 sets the glass bulb position within the screw base shown in FIG. 3.

Figure 3:
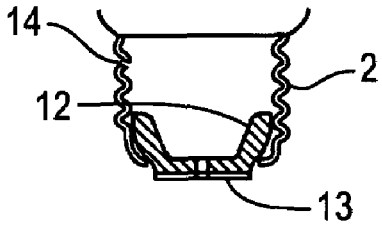
FIG. 3 PRIOR ART
FIG. 3 shows a standard Edison screw base

In the cross-sectional view of FIG. 3 is shown that the screw base consists of an outer electrically conductive shell, to which is bonded an inner glass insulator 12, having a small opening in its center. There is bonded to the lower portion of the glass insulator and a lower, disc-shaped electrically conductive element 13 also having a small centrally located hole. The disc opening allows a connective wire to be passed through it and soldered. The outer shell also has a small hole 14 near it upper edge to similarly accept a connective wire.

Figure 4:
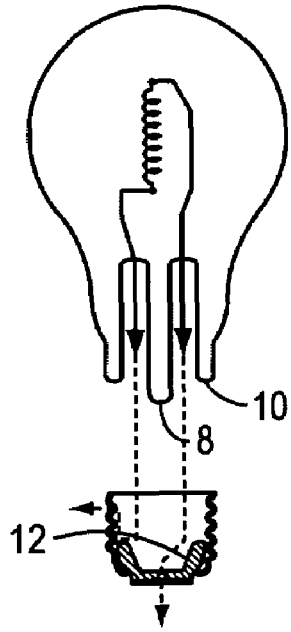
FIG. 4 PRIOR ART
FIG. 4 shows a lamp glass envelope and screw base prior to mating

FIG. 4 shows the glass bulb just prior to mating with the screw base. One wire 4 from the filament is directed toward the opening in the screw base disc and the second wire 5 is directed to the small opening in the screw shell. After mating, the lower rim of the glass bulb 10 will become seated against the top of the glass screw shell insulator 12. The lower protruding, sealed end 8 of the glass bulb extends downward toward a small opening in the insulator, that opening being just above a similar opening in the metallic disc in the metallic disc, and both such openings being of a size to allow passage of a connective wire.

Figure 5:
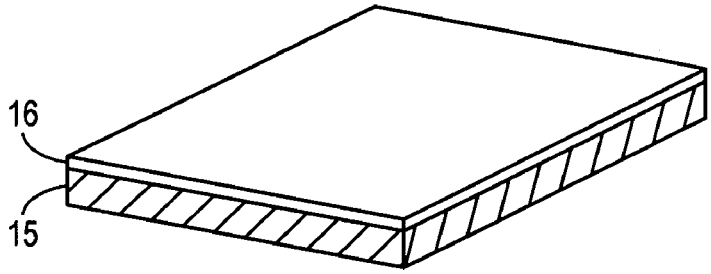
FIG. 5 show a copper layer on a circuit board laminate base material

FIG. 5 shows a simplified view of a printed circuit board laminate prior to final processing. It consists of a base insulative material 15 which can be of any number of materials such as epoxy-glass composition, polyimide, paper-base compositions or similar insulative materials. A thin metallic, virtually always copper, foil 16 is bonded to the insulative material 15. The insulative material typically ranges from about 0.030" to 0.062" but can be as thin and 0.001" or as thick as 0.125". The copper foil typically ranges from about 0.001" up to 0.006 but can be as thick as 0.010 or more"

The copper layer 16 can be on one side or both and, while FIG. 5 shows a simple single layer, there can be many layers. Complex computer circuit boards can have 30 or more layers, which are stacked in alternating layers of insulator and foil. The layers are bonded together, using, adhesives, high pressure and heat in a manner similar to that of plywood manufacturing. The use of such multi-layer circuit boards can be advantageous in creating somewhat complex circuit patterns in a very small area. Those skilled in complex circuit board design are familiar with the advantages of multiple layers. While the proposed embodiment does not necessarily require the use of such multi layer circuit board, it would be obvious to those skilled in the art that more complex functions could be readily added to the proposed embodiment for certain performance enhancements if multi-layer circuit board techniques were employed.

Figure 6:
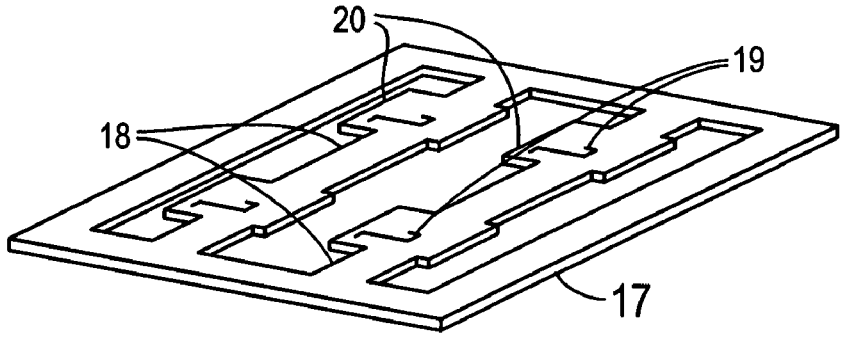
FIG. 6 shows multiplicity of circuit boards as manufactured in palletized form
Figure 7:
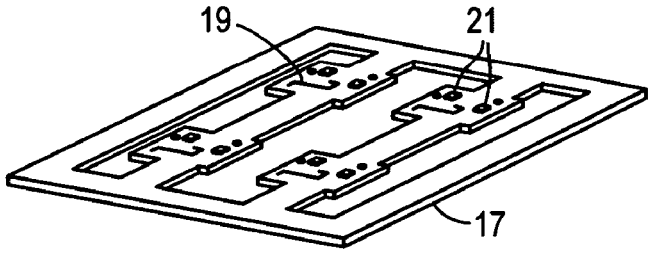
FIG. 7 shows the circuit boards after components are attached
Figure 8:
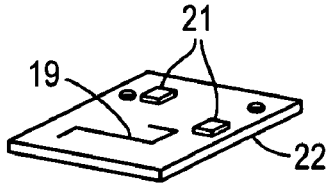
FIG. 8 shows an individual circuit board after separation from the pallet
Figure 9:
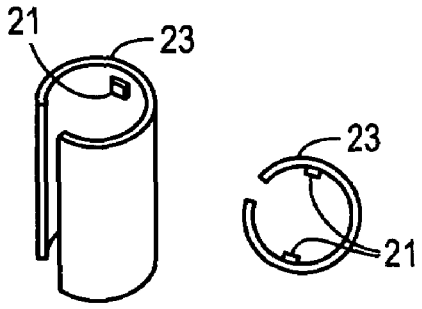
FIG. 9 shows an individual circuit board after forming.

FIG. 6 shows what is called a printed-circuit-board pallet 17, in which many circuit board patterns 19 are formed on a large section of material. In this figure there is shown a technique whereby circuit board material is removed by routing and only narrow mechanical connective links 18 exist between each individual circuit board 20 and the original large section of material. FIG. 7 depicts the same pallet after individual surface mount components 21 have been added to each individual circuit board 20. FIG. 8 shows an individual circuit board 20 after it has been snapped or broken away from its original position in the group of circuit boards 20 in FIG. 6. The separated flat circuit board 20 is formed into a cylindrical shape 23 as shown in FIG. 9. A surface mount component 21 as seen on the inside surface.

Figure 10:
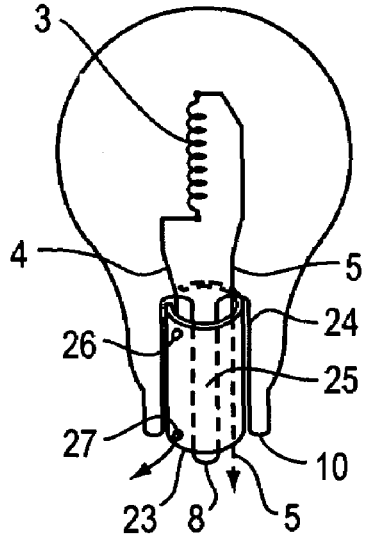
FIG. 10 shows the cylindrical circuit board after insertion into the glass envelope
Figure 11:
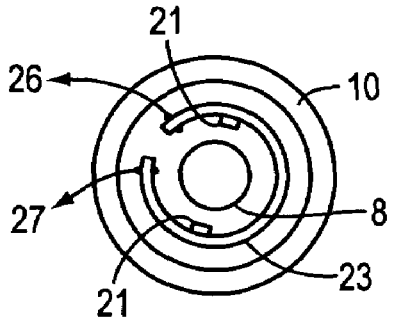
FIG. 11 shows a bottom view of the inserted circuit board after insertion.

FIG. 10 shows the cylindrically shaped circuit board inserted into the cylindrical cavity of the glass bulb. The combined thickness of the circuit board and the surface-mounted components must not exceed the space between the inner glass-sealed tube 24 and the outer glass bulb cylindrical portion 25. One of the wires from the filament, normally directed to the metallic disc in the screw base, is instead directed to a connection point of the circuit board 26. Another wire is affixed to a second circuit board point 27 and then directed to the screw-base metallic disc. In other words, the circuit board is inserted into what would have been a direct filament-to-screw-base connection. FIG. 11 shows a simplified bottom view of the arrangement of FIG. 10

Figure 12:
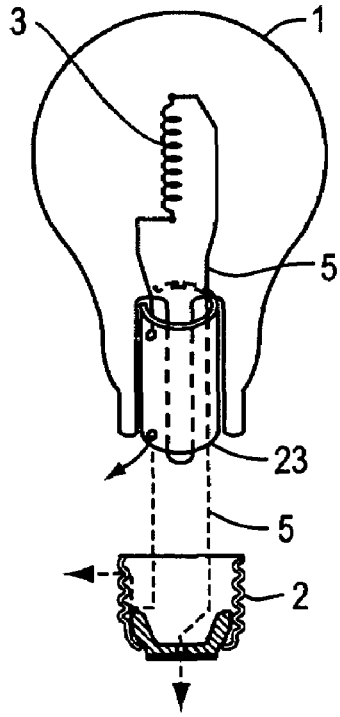
FIG. 12 shows the glass envelope, cylindrical circuit board and screw base prior to mating
Figure 13:
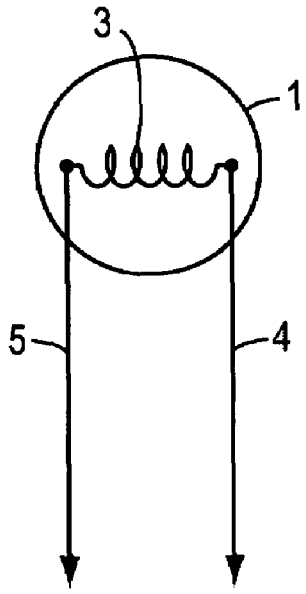
FIG. 13 PRIOR ART
FIGS. 13, 14 and 15 show, respectively, the equivalent circuits for a standard lamp, one with the added embodiment and one with further enhancement.
Figure 14:
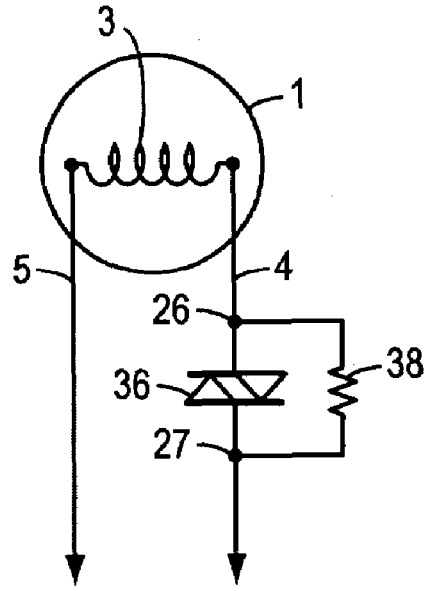

FIG. 12 show an assembly much like that of FIG. 4 but with the cylindrical circuit board inserted into the cylindrically bulb cavity and the electronics of the circuit board in the electrical path from the filament to the screw base. FIG. 13 depicts a normal lamp connection, and FIG. 14 shows a preferred embodiment incorporating the present invention. The schematic shows a Sidac 36 used to establish a fixed phase control of the lamp in a manner outlined in U.S. Pat. No. 4,980,607. An optional resistor 38 is in parallel with the Sidac to enhance circuit operation under certain conditions.

Those skilled in the art will recognize that the circuitry between points 26 and 27 of FIG. 13 might incorporate other components such as Triacs, SCR's, transistors and a various other electronic components.

Figure 15:
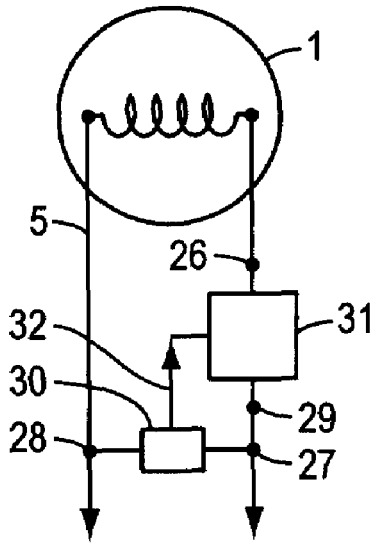

FIG. 15 shows a circuit in which the cylindrical circuit board also has provision for two additional connections, 28 and 29. It is apparent in FIG. 12 that one of the wires from the filament was directed right to the outer screw shell. However, if that wire were to be first connected 26 to the circuit board and another wire from the circuit board 27 to the screw shell, additional circuitry 30 of figure could be incorporated. The circuit 31 in series with one of the filament leads could be the triac and resistor combination of FIG. 14 that might be controlled by the auxiliary circuit 30 connected from 28 to 29 which is on the circuit board. The connections 28 and 29 (connected to 27) are located across the AC line voltage. FIG. 15 shows the two types of circuit connections and depicts a control signal 32 from the auxiliary circuit to the series-connected circuit.

FIG. 15 illustrates that both sides of the AC mains can be accessed. Those skilled in the art will recognize that having access to both sides of the AC mains allows more flexibility in creating the low voltage DC levels required by integrated circuits to achieve enhanced lamp-performance.

In the various figures describing the invention, the most popular residential lamp, known as the medium-base type, are shown Those skilled in the art will recognize that other lamps may advantageously incorporate the present invention. For example, the present invention may be used with halogen lamps that, although having a different filament, glass envelope and filament design, with the glass envelope filled with a performance-enhancing gas, are, nevertheless, incandescent lamps with screw bases attached to sealed glass envelopes as shown in FIGS. 2, 3 and 4.

Similarly, smaller lamps, known as candelabra types, have the base of the glass envelope situated within a screw base cavity in an overall configuration comparable to FIGS. 2,3 and 4, with the result that the present invention is applicable to candelabra type lamps as well. Only the physical size of the curved circuit board 23 (FIGS. 10, 11 and 12) needs to be smaller to accommodate the more confined space.

With candelabra type lamps, the wattage rating is invariably much less than that typical of the more popular medium base lamps and the lower level of heat generated from the Sidac chip, make sit that much easier to employ a smaller heat removing circuit board.

It should be understood that above-described embodiments are being presented herein as examples and that many variations and alternatives thereof are possible. Accordingly, the present invention should be viewed broadly as being defined only as set forth in the hereinafter appended claims.

What is claimed is:

1. An incandescent lamp assembly having a glass envelope arranged with a recess wherein first and second electrical leads exit the envelope via gas tight seals, and wherein the envelope extends around the recess, the extension and recess arranged for receiving a socket, wherein the socket is arranged for receiving third and fourth electrical leads and continuing the electrical connections from the third and fourth electrical leads to two external power source connections, the lamp assembly further comprising:

a circuit board molded to fit within the envelope recess, means for making electrical contact from the circuit board to at least one of the first and second electrical leads, means for making an electrical contact from at least one of the third and fourth electrical leads to the circuit board, an electrical circuit arranged on the circuit board for controlling power to the lamp filament, wherein the completed lamp assembly including the circuit board and a metal base maintains the external physical dimensions of the assembly such that the assembly fits into standard incandescent light fixtures.

2. The lamp assembly of claim 1 wherein the electrical circuit comprises a thyristor-type device in series with one lamp filament wherein the thyristor-type defines a breakdown threshold with respect to an AC power source wherein the power delivered to the filament is reduced by a defined portion of the AC power cycle.

3. The lamp assembly of claim 1 further comprising:

means for making an electrical contact from the circuit board to the other of the first and second electrical leads, wherein both filament leads make contact to the circuit board, a second electrical circuit on the circuit board, the second electrical circuit making electrical connections to both the third and the fourth electrical leads, wherein the second electrical circuit interacts with the first electrical circuit to control the power to the lamp filament.

4. The lamp assembly of claim 1 wherein the circuit board is arranged with a thermally conductive section arranged to lower a thermal resistance from the board to an external heat sink.

5. A method for controlling an incandescent lamp assembly having a glass envelope arranged with a recess wherein first and second electrical leads exit the envelope via gas tight seals, and wherein the envelope extends around the recess, the extension and recess arranged for receiving a socket, wherein the socket is arranged for receiving third and fourth electrical leads and continuing the electrical connections from the third and fourth electrical leads to a metal base and via a standard fixture to two external power source connections, the method comprising the steps of:

forming a circuit board to fit within the envelope recess, making electrical contact from the circuit board to at least one of the first and second electrical leads, making an electrical contact from at least one of the third and fourth electrical leads to the circuit board, controlling power to the lamp filament with an electrical circuit arranged on the circuit board, and wherein the completed lamp assembly including the circuit board and a metal base maintains the external physical dimensions of the assembly such that the assembly fits into standard incandescent light fixtures.

6. The method of claim 5 wherein the step of controlling the power to the lamp filament comprises the step of allowing only a portion of the power source by employing a thyristor-type device in series with one lamp filament wherein the thyristor-type defines a breakdown threshold with respect to an AC power source wherein the power delivered to the filament is reduced by a defined portion of the AC power cycle.

7. The method of claim 5 further comprising the steps of:

making an electrical contact from the circuit board to the other of the first or second electrical leads, wherein both filament leads make contact to the circuit board, making electrical connections to both the third and the fourth electrical leads from a second electrical circuit on the circuit board, controlling power to the filament using the second electrical circuit located on the circuit board, wherein the second electrical circuit interacts with the first electrical circuit to control the power to the lamp filament.

8. The method of claim 5 further comprising the step of lowering a thermal resistance from the circuit board to the metal base and thence to the standard fixture by placing a thermally conductive section on the circuit board.

* * * * *